US007055438B1

(12) United States Patent
Manole et al.

(10) Patent No.: US 7,055,438 B1
(45) **Date of Patent: *Jun. 6, 2006**

(54) SYSTEM AND METHOD FOR A FLAMELESS TRACER/MARKER UTILIZING HEAT MARKING CHEMICALS

(75) Inventors: Leon R. Manole, Great Meadows, NJ (US); Stewart Gilman, Budd Lake, NJ (US); Erinn Harbeck McCarthy, Randolph, NJ (US); Steven Kelley, Stanhope, NJ (US); Remi Chian, Brooklyn, NY (US); Melissa Wanner, Delaware Water Gap, PA (US); Ernest Logsdon, Newton, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/707,272

(22) Filed: Dec. 2, 2003

Related U.S. Application Data

(60) Provisional application No. 60/481,529, filed on Oct. 21, 2003.

(51) Int. Cl.
*F42B 12/38* (2006.01)
*F42B 12/40* (2006.01)

(52) U.S. Cl. ..... 102/513; 102/502; 364/34

(58) Field of Classification Search ..... 102/513, 102/458, 502; 362/34
See application file for complete search history.

(56) References Cited

U.S. PATENT DOCUMENTS 3,774,022 A * 11/1973 Dubrow et al. ..... 362/34
3,835,782 A * 9/1974 Griffith et al. ..... 250/302
5,018,450 A * 5/1991 Smith ..... 102/513
5,415,151 A * 5/1995 Fusi et al. ..... 124/56
6,298,841 B1 * 10/2001 Cheng et al. ..... 124/56
6,497,181 B1 * 12/2002 Manole et al. ..... 102/513
2002/0134274 A1 * 9/2002 Martinez et al. ..... 102/513

OTHER PUBLICATIONS

Chemicon International, Material Safety Data Sheet, Apr. 2003, Chemicon International, p. 1 of 29.*

* cited by examiner

*Primary Examiner*—Michael J. Carone
*Assistant Examiner*—Bret Hayes
(74) *Attorney, Agent, or Firm*—Michael C. Sachs; John F. Moran

(57) ABSTRACT

A flameless tracer/marker provides heat mark chemicals with optional chemlucents chemicals that can be carried and delivered by a projectile to mark a target. This marking payload may be carried by small, medium and large caliber projectiles that are part of ammunition items including 20 and 40 mm grenade launched, 90 mm, 105 and 120 mm tank, 60, 81 and 120 mm mortar and 105 and 155 artillery ammunition. This ammunition is gun launched and the projectiles can provide a heat trace to the target and/or upon impact with the target the projectile breaks or shatters and leaves a heat signature on the target for up to several hours. Included with these heat chemicals may be optional chemlucents. This heat mark may be placed into a lethal and non-lethal projectile. This allows heavy and light armor targets, vehicles, buildings and personnel to be marked without extensive damage to the target and without seriously injuring a person. The target may now be heat marked and chemlucent marked.

8 Claims, 4 Drawing Sheets

SYSTEM AND METHOD FOR A FLAMELESS TRACER/MARKER UTILIZING HEAT MARKING CHEMICALS

CROSS REFERENCE TO RELATED APPLICATIONS

This application claims benefit under 35 USC 119(e) of provisional application 60/481,529, filed 21 Oct. 2003, the entire file wrapper contents of which provisional application are herein incorporated by reference as though fully set forth at length.

FEDERAL RESEARCH STATEMENT

The inventions described herein may be manufactured, used, and licensed by, or for the U.S. Government for U.S. Government purposes.

BACKGROUND OF INVENTION

1. Field of the Invention

This invention relates to munitions employed for training and tactical purposes. More particularly, the present invention relates to small arms, mortar and canon caliber munitions comprising a heat mark or signature including optional IR or visible chemlucent chemicals that can be seen by thermal and/or night vision devices (NVD) used by the U.S. military and their allies either during flight as a projectile tracer or delivered to a target for marking.

2. Background of the Invention

In both military and non-military organizations, training and tactical exercises commonly employ standard ammunition items such as 40 mm, tank, artillery, and mortar munitions. Projectiles such as these commonly carry explosives, pyrotechnics, chemiluminescents, and florescent powders. Explosives are used to defeat or destroy targets. Pyrotechnics are used to light a battlefield or provide a trace of the projectile flight. Chemiluminescents (reference is made to U.S. Pat. No. 6,497,181) can be used to mark a target in low light conditions in visible and IR light without any flame source and little heat output. Chemiluminescents may also be used to provide a trace of the projectile flight, as also taught in said U.S. Pat. No. 6,497,181. Florescent powders are used to mark a target during the day to show target impact location. As further used in this specification, the term "chemlucent" or "chemilucent" shall refer to chemiluminescent chemicals, such as are referred to in said U.S. Pat. No. 6,497,181 and other examples as later described in this specification such as in paragraphs [Para 23], [Para 24], [Para 28], [Para 34]. [Para 39], and [Para 40]. The lower case "chemlucent" and "chemilucent" are generally preferred to be used in this specification in place of the upper case words "CHEMLUCENT" and "CHEMILUCENT", and done further to avoid possible confusion to ChemLucent™ & ChemiLucent™, which are registered marks of CHEMICON International Company, Temecula, Calif. The latter deal with chemicals having peroxide solutions other than what are generally described in this specification.

Although this technology has proven to be useful, it would be desirable to present additional improvements. What is needed is a projectile that can mark a target with both heat and chemlucents or just heat. This marking may be visible during the day or night when viewed with thermal and/or night vision devices (NVD). The need for such a system has heretofore remained unsatisfied.

SUMMARY OF INVENTION

The present invention satisfies this need, and presents a system and an associated method (collectively referred to herein as "the system" or "the present system") for marking a target with heat and optional chemlucents using small, medium and large caliber ammunition.

Targets marked with a heat mark or signature that may comprise optional IR or visible chemlucents can be seen by thermal and/or night vision devices (NVD) used by the U.S. military and their allies. The present system provides a heat mark chemicals with optional chemlucents chemicals that can be carried and delivered by a projectile to mark a target. This marking payload may be carried by small, medium and large caliber projectiles that are part of ammunition items including 20 and 40 mm grenade launched, 90 mm, 105 and 120 mm Tank, 60, 81 and 120 mm mortar and 105 and 155 artillery ammunition. This ammunition is gun launched. The projectiles can optionally provide a heat trace to the target. These projectiles are loaded into their appropriate cartridges using conventional components.

Upon impact with the target, the projectile breaks or shatters and leaves a heat signature on the target for up to several hours. Included with these heat chemicals may be optional chemlucents taught in U.S. Pat. No. 6,497,181. This heat mark may be placed into a lethal and non-lethal projectile. The present system allows heavy and light armor targets, vehicles, buildings and personnel to be marked without extensive damage to the target and without seriously injuring a person. The target may now be heat marked and chemlucent (optional) marked.

Tracer/marker projectiles are chambered in and fired from a gun in the same manner as all other ammunition. When fired, the primer is set off and the gases from the primer propel the projectile down the gun tube. The force exerted on the projectile as it begins to move is called the set-back force. The set-back force breaks the vials and/or bags of heat and optional chemlucent chemicals in the projectile. The heat and optional chemlucent chemicals mix and emit heat and light (optional). The optional chemlucents may emit IR or visible light, depending on the formulation of the chemlucent chemical.

The projectile continues down the tube and engages the rifling, which spins up the projectile. If the projectile is launched in a smooth bore gun tube, a canted fin imparts the spin to the projectile during flight. The heat chemicals and optional chemlucent chemicals become well mixed during flight and emit heat and light (optional). If the windshield or projectile is transparent or translucent, the optional chemlucent light provides a trace of the flight path to the target. The observer can follow the projectile flight by eye or NVD or heat vision equipment. If the projectile is opaque, the observer will not see any light emitted by the projectile during flight.

The projectile is typically made of plastic or composites in at least the front end of the projectile. Upon projectile impact with the target, the projectile shatters and deposits the heat chemical and chemlucent chemical (optional) on the targets. The target is now marked with heat for several hours. Optional chemlucents included in the projectile can emit IR or visible light.

Common to industry are conventional chemicals which, when mixed with liquids such as water or salt water will generate heat. Powdered metals (i.e., iron, aluminum etc.), when mixed with water or salt water will generate heat. Other chemicals, such as salts (i.e., calcium chloride or sodium acetate) when mixed with water or salt water will generate heat. Other chemicals may be used in the heat mark, i.e., Hydroxyethyl cellulose (HEC) as a thickening agent to control the thickness of the slurry so that it sticks better on the target. Silicone can be added to the mixture to also help the heat mark to stick to the target but will also serve as an insulator to prevent the heat from being drawn-off by target materials such as metals. The silicone can also make bag materials (optional) stick to intended targets. The silicone and HEC can therefore allow the heat mark to last a long time on the intended targets. Propylene glycol or other antifreeze agents may be added to the water to prevent freezing in cold locations.

In an embodiment, the heat chemicals and optional chemlucent chemicals may be contained in bags in the projectile. These bags are designed to not break on target impact, remaining intact on the target and providing the desired target mark.

BRIEF DESCRIPTION OF DRAWINGS

The various features of the present invention and the manner of attaining them will be described in greater detail with reference to the following description, claims, and drawings, wherein reference numerals are reused, where appropriate, to indicate a correspondence between the referenced items, and wherein:

DETAILED DESCRIPTION

Figure 1A:
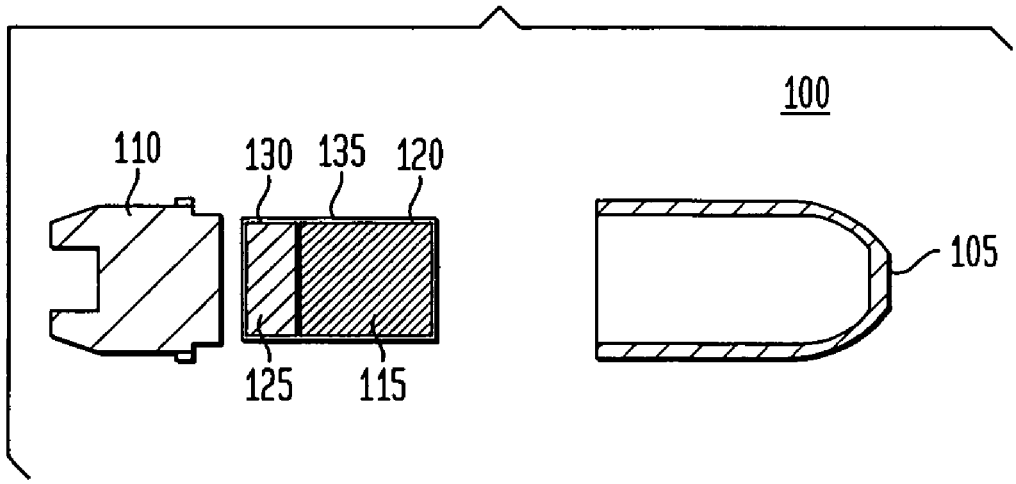
FIG. 1 is comprised of FIGS. 1A and 1B and represents a cutaway view of a 40 mm projectile showing the location of heat marking chemicals in bags suspended in silicone liquid or gel and the location of a transparent or translucent or opaque plastic or composite windshield.
Figure 1B:
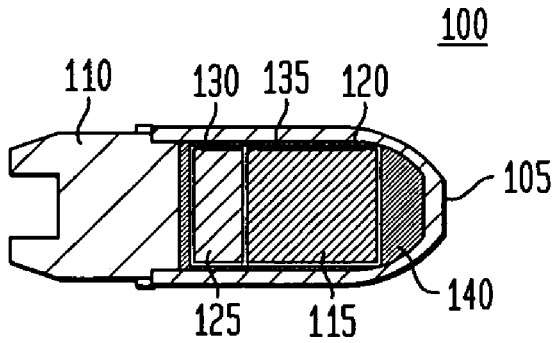

FIG. 1 (FIGS. 1A, 1B) is a diagram of a 40 mm projectile 100 (projectile 100). FIG. 1A is a cut-away exploded view of projectile 100. Projectile 100 comprises a windshield 105 and a back end 110. Windshield 105 may be transparent or translucent and comprises polypropylene. In an embodiment, windshield 105 is opaque. In still another embodiment, the windshield 105 is made of non-heat conducting materials, or painted with non-heat conducting paint, or lined on the inside of the windshield with a non-heat conducting liner (not shown). The back end 110 comprises zinc. Heat chemicals 115 comprising calcium chloride and thickener hydroxyethyl cellulose, or cellulose acetate butyrate, are contained in bag 120. Bag 120 is comprised of low-density polyethylene. In an alternate embodiment, powdered metals or sodium acetate are used with the calcium chloride in 115.

Liquid 125 comprising hydrogen peroxide and salt water possibly with propylene glycol are contained in bag 130. Bag 130 comprises polyester. Bag 120 and bag 130 are contained in containment bag 135. Containment bag 135 comprises 100 gauge nylon. During gun launch of projectile 100, bag 120, and bag 130 breaks, mixing liquid 125 with heat chemical 115. Containment bag 135 is designed to break on target impact by projectile 100. In an embodiment, containment bag 135 is designed to remain intact on target impact by projectile 100.

FIG. 1B is a cut-away view of projectile 100 showing the placement of containment bag 135 in projectile 100. Projectile 100 also comprises a silicone liquid or gel 140. The silicone 140 is used as a insulating agent as well as providing a sticky substance to help the heat mark or bag to stick to the target. In an embodiment, chemlucent chemicals in separate bags may also be placed in bag 130 or in projectile 100.

Figure 2A:
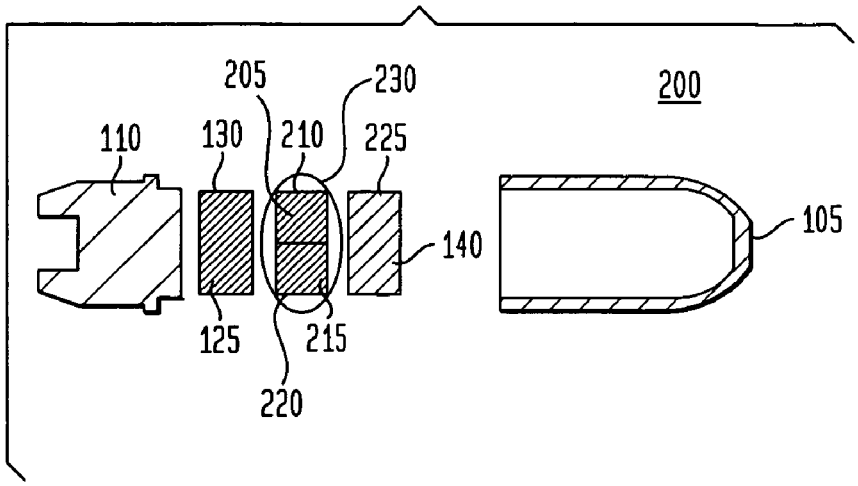
FIG. 2 is comprised of FIGS. 2A and 2B and represents a cutaway view of a 40 mm projectile showing the location of heat marking chemicals in bags and chemlucent materials in bags suspended in silicone liquid or gel and the location of a transparent or translucent or opaque plastic or composite windshield.
Figure 2B:
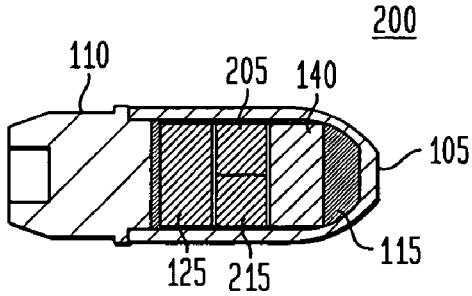

FIG. 2 (FIGS. 2A, 2B) is a diagram of a 40 mm projectile 200 (projectile 200). FIG. 2A is a cut-away exploded view of projectile 200. Projectile 200 comprises windshield 105 and back end 110. Liquid 125 is contained in bag 130. Optional chemlucent chemical 1, 205, is contained in bag 210. Optional chemlucent chemical 2, 215, is contained in bag 220. Optional silicone gel 140 is contained in bag 225. Chemlucent chemical 1, 205, and chemlucent chemical 2, 215, are collectively referenced as chemlucent chemicals 230.

FIG. 2B is a cut-away view of projectile 200 showing placement of bags 130, 210, 220, 225 and heat chemicals 115 inside projectile 200. Heat chemicals 115 are placed in projectile 200 with bag 120. In an embodiment, optional bags 210, 220, and 225 are also placed in projectile 200. During gun launch of projectile 200, bag 130 and 120 breaks, mixing liquid 125 with heat chemical 115. In an embodiment, optional bags 210, 220, and 225 also break during gun launch, mixing liquid 125, chemlucent chemicals 230, and silicone liquid or gel 140 with heat chemical 115. In an alternate embodiment powdered metals or sodium acetate or other salts may be used with or in place of calcium chloride in 115.

Figure 3:
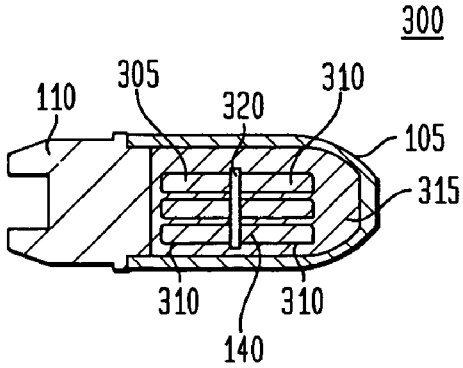
FIG. 3 is a cutaway view of a 40 mm projectile showing the location of heat marking chemicals in vials suspended in a plastic spider.

FIG. 3 is a diagram of a 40 mm projectile 300 (projectile 300) showing a cutaway view of projectile 300. Projectile 300 comprises windshield 105 and back end 110. A gel 305 is placed in one or more sealed glass vials 310. Gel 305 comprises water, propylene glycol, salt NaCl and hydroxyethyl cellulose. Glass vials 310 are commonly manufactured in industry by melting the ends of glass tubes. Glass vials 310 are surrounded by heat chemicals 315 comprising calcium chloride, or sodium acetate. The glass vials 310 are held apart by a plastic piece, termed a composite spider 320. The glass vials 310 slide into and are held apart by holes in the spider 320. Some of the glass vials 310 are filled with silicone liquid and gel 140. In another embodiment, the glass vials 310 are placed directly into the heat chemicals 315.

Figure 4:
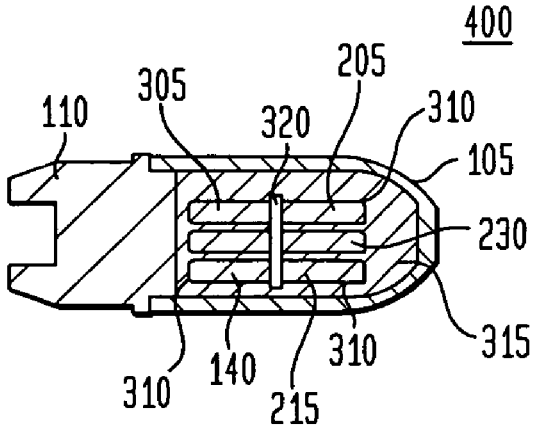
FIG. 4 is a cutaway view of a 40 mm projectile showing the location of heat marking chemicals in vials and chemlucent material in vials suspended in a plastic spider.

FIG. 4 is a diagram of a 40 mm projectile 400 (projectile 400) showing a cut-away view of projectile 400. Projectile 400 comprises windshield 105 and back end 110. Gel 305 is placed in sealed glass vials 310. Optional chemlucent chemical 1, 205, and chemlucent chemical 2, 215, are placed in separate glass vials 310. Glass vials 310 are surrounded by heat chemicals 315 comprising, for example, calcium chloride, and/or sodium acetate, and/or other salts and/or thickening agents such as hydroxyethyl cellulose. The glass vials 310 are held apart by a plastic or composite spider 320.

The glass vials 310 slide into and are held apart by holes in the spider 320. In an embodiment, silicone liquid or gel 140 is placed in some of the glass vials 310. In another embodiment, the glass vials 310 may be placed directly into the heat chemicals 315.

During gun launch of projectiles 300, 400, the glass vials 310 break, mixing gel 305, chemlucent chemicals 230, heat chemicals 315, and silicone liquid or gel 140. Upon impact with the target, projectile 300, 400 windshields 105 break, scattering this mixture over the target.

The method of assembling heat chemicals 115, 315, chemlucent chemicals 230, silicone liquid or gel 140, gel 305, and liquids 125 as presented in FIGS. 1, 2, 3, and 4 for a 40 mm projectile may be applied to any small, medium, or large caliber size projectile. Assembly of these all these projectiles is done by placing the aforementioned chemicals into the windshield 105 and then attaching the windshield to the back end 110 by thread (not shown) and/or epoxy (not shown).

Figure 5:
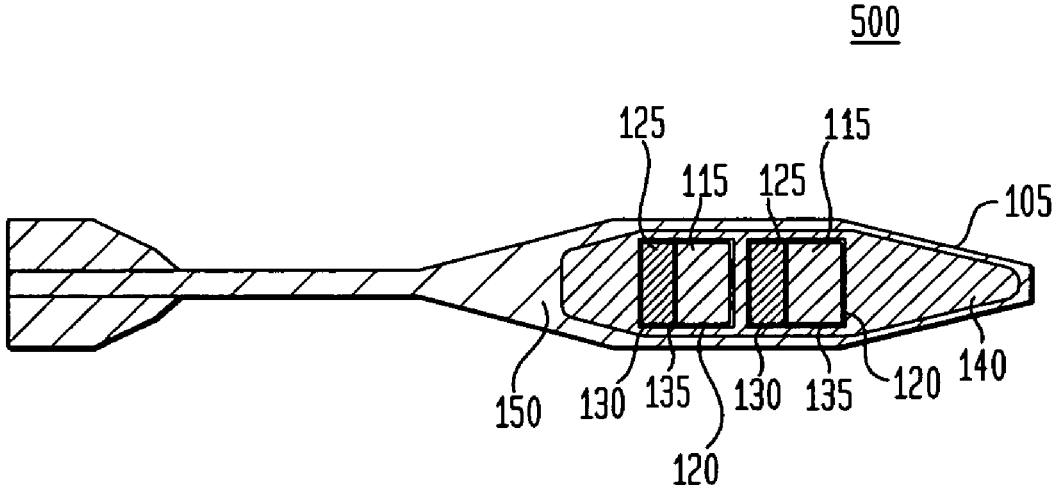
FIG. 5 is a cutaway view of a mortar projectile showing locations for heat marking chemical in bags and optional chemlucent material in bags suspended in silicone liquid or gel.

FIG. 5 is a diagram of a mortar projectile 500 (projectile 500) showing a cut-away view of projectile 500. Heat chemicals 115 are contained in bag 120. Bag 120 may be comprised of low-density polyethylene. Liquid 125 is contained in bag 130. Bag 130 comprises, for example, polyester. Bag 120 and bag 130 are contained in containment bag 135. Containment bag 135 comprises, for example, 100 gauge nylon. Projectile 500 also comprises a silicone liquid or gel 140. In an embodiment, chemlucent chemicals in separate bags may also be placed in containment bag 135. During gun launch of projectile 500, bag 120 and bag 130 break, mixing liquid 125 with heat chemical 115. Containment bag 135 is designed to break on target impact by projectile 500. In an embodiment, containment bag 135 is designed to remain intact on target impact by projectile 500.

Figure 6:
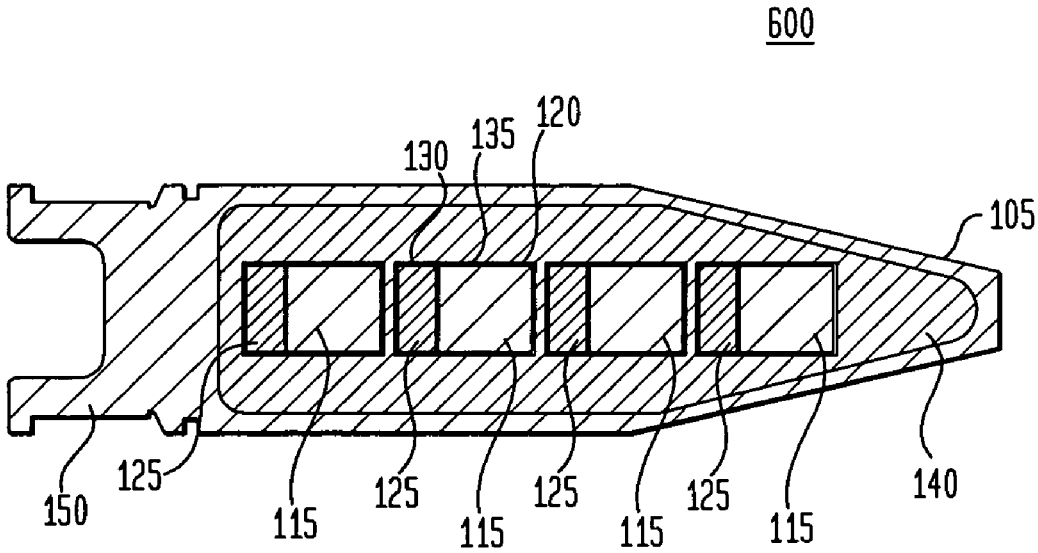
FIG. 6 is a cutaway view of a large caliber tank or artillery projectile showing locations for heat marking chemical in bags and optional chemlucent material in bags suspended in silicone liquid or gel.

FIG. 6 is a diagram of an artillery or tank projectile 600 (projectile 600) showing a cut-away view of projectile 600. Heat chemicals 115 are contained in bag 120. Bag 120 may be comprised of low-density polyethylene. Liquid 125 is contained in bag 130. Bag 130 comprises, for example, polyester. Bag 120 and bag 130 are contained in containment bag 135. Containment bag 135 comprises, for example, 100 gauge nylon. Projectile 600 also comprises a silicone liquid or gel 140. In an embodiment, chemlucent chemicals in separate bags may also be placed in containment bag 135. During gun launch of projectile 600, bag 120, and bag 130 break, mixing liquid 125 with heat chemical 115. Containment bag 135 is designed to break on target impact by projectile 600. In an embodiment, containment bag 135 is designed to remain intact on target impact by projectile 600.

The mortar projectile 500 and tank and artillery projectiles 600 may utilize the same alternate embodiments as shown for the 40 mm projectile 100, 200, 300, 400 in FIGS. 1, 2, 3, and 4. In addition, heat chemicals 115, 315 and optional chemlucent chemicals 230 may be placed into any non-lethal projectile. The projectiles 100, 200, 300, 400, 500, and 600 are assembled as depicted in FIGS. 1, 2, 3, 4, 5, and 6 and are then loaded into cartridges. The cartridges consist of a cartridge case, primer with a propellant system and the projectile. All these parts are common to the ammunition industry and assembled in accordance with the industry standard. The assembled cartridge is chambered in a gun in a manner similar to all other ammunition that is fired from a gun. The chamber is closed and the cartridge is fired in the same manner as all other ammunition.

When the gun is fired, a primer/propellant is ignited. The gases from the primer/propellant propel the projectile 100, 200, 300, 400, 500, 600 down the gun tube. The force exerted on the projectile 100, 200, 300, 400, 500, 600 as it begins to move is the set-back force. The setback force breaks the vials 310 or bags 120, 130, 135, 210, 220 in the projectile 100, 200, 300, 400, 500, 600. The heat chemicals 115, 315 mix and emit heat. In an embodiment, optional chemlucent chemicals 230 mix and emit light. If the optional chemlucent chemicals 230 are of IR formulation, IR light is emitted. If the optional chemlucent chemicals 230 are of visible formulation, visible light is emitted.

The projectile 100, 200, 300, 400, 500, 600 continues down the tube and engages rifling, which spins the projectile 100, 200, 300, 400, 500, 600. If fired in a smooth bore gun tube, the the projectile 100, 200, 300, 400, 500, 600 acquires spin during flight from a canted fin (not shown). Because of the spin, the heat chemicals 115, 315 become well mixed and emit heat. In an embodiment, optional chemlucent chemicals 230 become well mixed and emit light.

In one embodiment, projectile 500 or 600 comprises a windshield 105 and a back end 150. Windshield 105 may be transparent or translucent and comprise, for example, polypropylene or polyethylene. In another embodiment, windshield 105 is opaque. In still another embodiment, the windshield 105 is made of non-heat conducting materials or painted with non-heat conducting paint or lined on the inside of the windshield with a non-heat conducting liner. The back end 150 of projectile 500 or 600 may be made of steel, aluminum or a transparent or translucent or opaque plastic or composite material.

For all projectiles 100, 200, 300, 400, 500 and 600 shown in FIGS. 1–6, the material of the windshield 105 and/or the material of the back end 110 or 150 are made of a material to accomplish the need or requirement of the user. If the user requires a heat trace of the projectile flight to the target as well as a mark on the target then the windshield 105 and/or the back end 110 or 150 can be made of a material that conducts heat and will break upon target impact to deposit the heat mark on the target. It is not necessary that the back end 110 or 150 breaks only that the windshield 105 breaks.

If the user requires a heat trace and a light trace from the optional chemlucents then in addition to the windshield 105 being made of a heat conducting material it must also be transparent or translucent to allow the light to pass through. If the user requirement is to have mark on the target only with no trace of the projectile flight then the windshield 105 and back end 110 or 150 must be opaque (to prevent light passage, only if optional chemlucents are used) and/or made of a material that does not conduct heat. A paint or inner liner to prevent the heat from coming through the windshield 105 or back end 110 or 150 may also be used to prevent a heat trace or light trace of the projectile flight to the target.

The heat conducting windshield 105 or back end 110 or 150 of projectiles 100, 200, 360, 400, 500, and 600 allows heat emitted by heat chemicals 115, 315 to be visible to an observer, providing a trace of the flight path to the target using NVD or heat vision equipment. In an embodiment, light emitted by optional chemlucent chemicals 230 is visible to an observer through a transparent or translucent windshield 105 or back end 110 or 150. If the windshield 105 or back end 110 or 150 of projectile is opaque, the observer does not see any light emitted by the projectile 100, 200, 300, 400, 500, 600 during flight. Likewise, if the windshield 105 and back end 110 or 150 is opaque and does not conduct heat then no heat or light trace of the projectile flight will be seen, only a mark on the target will be seen after the windshield 110 breaks and deposits the heat chemicals on target.

Projectiles 100, 200, 300, 400, 500, 600 typically comprise plastic or composites in at least the front end (windshield 105). Upon impact with the target, the projectile 100, 200, 300, 400, 500, 600, windshield 105 shatters and deposits the heat chemical 115, 315 and optional chemlucent chemical 230 on the targets. The target is now marked with heat for a time on the order of minutes to several hours depending on the formulation mixture. In an embodiment, the target is also marked with optional chemlucent chemicals 230 that emit IR or visible light. In a further embodiment, containment bag 135 is designed to remain intact when projectiles 100, 200, 300, 400, 500, 600 impact the target. Containment bag 135 remains intact and stays on the target while emitting the desired heat or light mark.

All drawings are illustrative in nature and do not depict the actual size or scale of the objects shown. It is to be understood that the specific embodiments of the invention that have been described are merely illustrative of certain applications of the principle of the present invention. Numerous modifications may be made to a system and method for a flameless marker/tracer utilizing heat marking chemicals as described herein, without departing from the spirit and scope of the present invention.

What is claimed is:

1. A flameless tracer utilizing heat marking chemicals, for use with a projectile, comprising:

a first heat chemical carried by the projectile for emitting heat during a flight of the projectile such heat visible to an observer with thermal sensing devices and/or night vision devices; and a second heat chemical delivered by the projectile, for marking a target upon impact by the projectile, wherein the first and second heat chemicals are contained in separate bags within the projectile, and said separate bags are contained in a containment bag, wherein the containment bag does not break during launch or flight of the projectile, but breaks on impact of the projectile with the target, scattering the second heat chemical on the target.

2. A flameless tracer utilizing heat marking chemicals, for use with a projectile, comprising:

a first heat chemical carried by the projectile for emitting heat during a flight of the projectile such heat visible to an observer with thermal sensing devices and/or night vision devices; and a second heat chemical delivered by the projectile, for marking a target upon impact by the projectile, wherein the first and second heat chemicals are contained in separate bags within the projectile, and said separate bags are contained in a containment bag, wherein the containment bag is installed in the projectile with a sticky substance; and wherein upon the projectile impacting the target, the sticky substance disperses over the target, causing the containment bag to adhere on the target.

3. The tracer of claim 2, wherein the sticky substance is made, at least in part, of silicone.

4. A flameless marker utilizing heat marking chemicals, for use with a projectile, comprising:

a first heat chemical carried by the projectile for emitting heat during a flight of projectile such heat visible to an observer with thermal sensing devices and/or night vision devices; and a second heat chemical delivered by the projectile, for marking a target upon impact by the projectile, wherein the first and second heat chemicals are contained in separate bags within the projectile, wherein the separate bags are contained in a containment bag, wherein the containment bag does not break during launch or flight of the projectile, but breaks on impact of the projectile with the target, scattering the second heat chemical on the target.

5. A flameless marker utilizing heat marking chemicals, for use with a projectile, comprising:

a first heat chemical carried by the projectile for emitting heat during a flight of the projectile such heat visible to an observer with thermal sensing devices and/or night vision devices; and a second heat chemical delivered by the projectile, for marking a target upon impact by the projectile, wherein the first and second heat chemicals are contained in separate bags within the projectile, wherein the separate bags are contained in a containment bag, wherein the containment bag does not break during gun launch, flight of the projectile, or impact of the projectile with the target, scattering intact containment bags with the second heat chemical on the target.

6. A flameless marker utilizing heat marking chemicals, for use with a projectile, comprising:

a first heat chemical carried by the projectile for emitting heat during a flight of the projectile such heat visible to an observer with thermal sensing devices and/or night vision devices; and a second heat chemical delivered by the projectile, for marking a target upon impact by the projectile, wherein the first and second heat chemicals are contained in separate bags within the projectile, wherein the separate bags are contained in a containment bag, wherein the containment bag is installed in the projectile with a sticky substance; and wherein upon the projectile impacting the target, the sticky substance disperses over the target, causing the containment bag to adhere on the target.

7. A flameless marker utilizing heat marking chemicals, for use with a projectile, comprising:

a first heat chemical carried by the projectile for emitting heat during a flight of the projectile such heat visible to an observer with thermal sensing devices and/or night vision devices; and a second heat chemical delivered by the projectile, for marking a target upon impact by the projectile, wherein the first and second heat chemicals are contained in separate bags within the projectile, wherein the separate bags are contained in a containment bag, wherein the containment bag is installed in the projectile with a sticky substance; and wherein upon the projectile impacting the target, the sticky substance disperses over the target, causing the containment bag to adhere on the target, wherein the sticky substance is made, at least in part, of silicone.

8. A flameless marker utilizing heat marking chemicals, for use with a projectile, comprising:

a first heat chemical carried by the projectile for emitting heat during a flight of the projectile such heat visible to an observer with thermal sensing devices and/or night vision devices; and a second heat chemical delivered by the projectile, for marking a target upon impact by the projectile, wherein the first and second heat chemicals are contained in a plurality of glass vials, wherein the glass vials are restrained by a plastic mounting piece.

* * * * *